United States Patent [19]

Schachter

[11] Patent Number: 4,606,070

[45] Date of Patent: Aug. 12, 1986

[54] COMBINED WIND SCREEN AND BEACH BAG

[76] Inventor: Robert A. Schachter, 130 Elwa Pl., West Palm Beach, Fla. 33405

[21] Appl. No.: 643,919

[22] Filed: Aug. 24, 1984

[51] Int. Cl.[4] ..... B65D 30/00

[52] U.S. Cl. ..... 383/4; 383/907; 190/1; 135/95

[58] Field of Search ..... 383/4, 127, 907; 190/1; 135/95, 115; 294/156; 160/135; 43/1

[56] References Cited

U.S. PATENT DOCUMENTS

| | | | |
|---|---|---|---|
| 1,033,578 | 7/1912 | Greenberg | 383/907 |
| 1,222,805 | 4/1917 | Schmid . | |
| 1,238,646 | 8/1917 | Dennis . | |
| 1,250,429 | 12/1917 | Carroll . | |
| 1,440,665 | 1/1923 | Fink | 160/135 |
| 1,595,929 | 2/1925 | Rhodes . | |
| 1,915,504 | 12/1930 | Stokby . | |
| 2,308,109 | 2/1941 | Rundquist . | |
| 2,445,622 | 4/1947 | Lewk . | |
| 2,465,147 | 3/1949 | Butler et al. . | |
| 2,554,688 | 5/1951 | Vollweiler | 135/95 |
| 2,784,779 | 3/1957 | Knipfer et al. . | |
| 3,143,748 | 8/1964 | Manning | 190/1 |
| 3,487,874 | 1/1970 | Solo . | |
| 3,561,518 | 2/1971 | Johnson . | |
| 3,913,598 | 10/1975 | Glutting, Jr. et al. . | |
| 4,127,196 | 11/1978 | Boucher . | |
| 4,180,112 | 12/1979 | Bovet | 383/4 |
| 4,180,867 | 1/1980 | Ridgeway, Jr. . | |
| 4,466,517 | 8/1984 | Spiegelman | 383/4 |
| 4,471,794 | 9/1984 | Kirkham, Jr. | 135/95 |

*Primary Examiner*—Joseph Man-Fu Moy
*Assistant Examiner*—David Fidei
*Attorney, Agent, or Firm*—Steele, Gould & Fried

[57] ABSTRACT

A combined wind screen and carrying bag is formed from an elongated sheet attached to stakes at opposite ends thereof, the sheet having pockets opening towards said stakes, formed by a seam intermediate the stakes, such that the entire screen can be folded along the seams and articles carried in the pockets.

6 Claims, 9 Drawing Figures

FIG. 7(a)
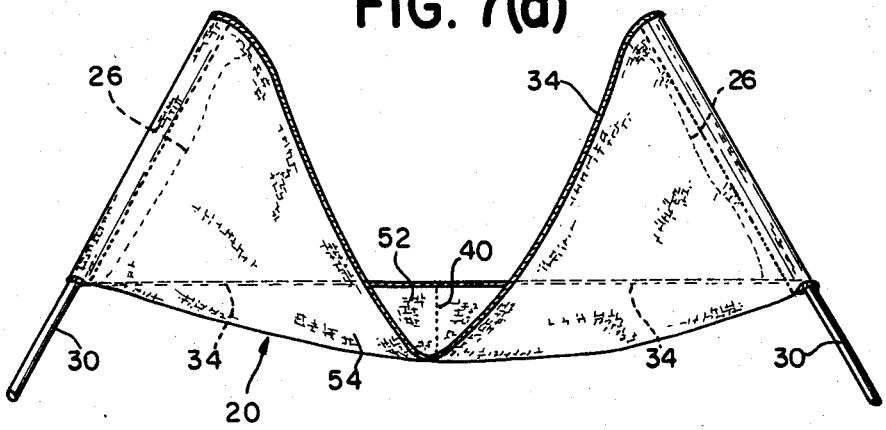
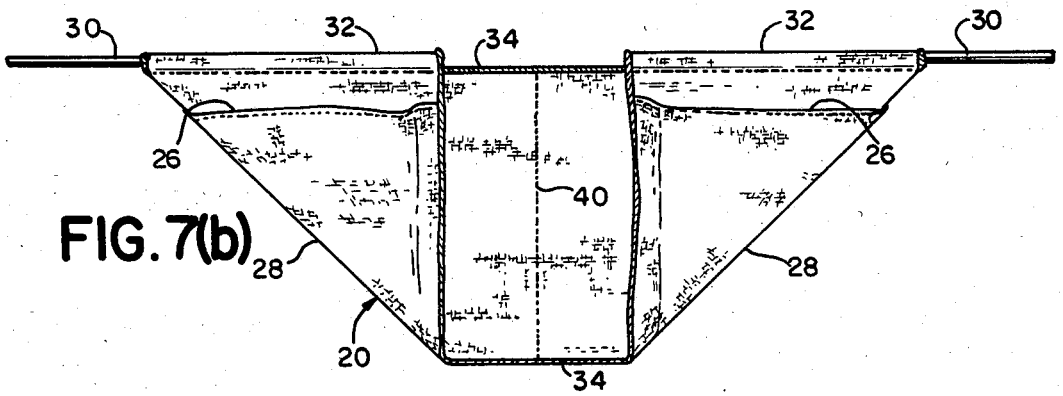
FIG. 7(b)
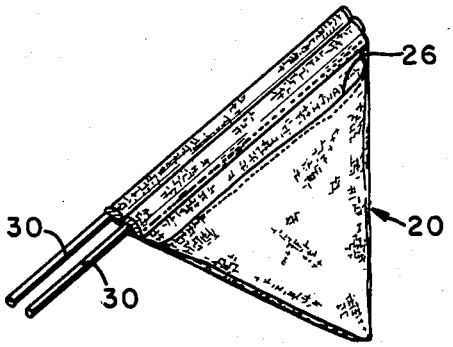
FIG. 7(c)

COMBINED WIND SCREEN AND BEACH BAG

BACKGROUND OF THE INVENTION

1. Field of the Invention

This invention relates to the field of wind screens and article-carrying bags, and especially to a compact apparatus that can be used to carry articles to a beach or other location, and there erected as a wind screen.

2. Description of the Prior Art

Wind screen structures which are transported by a user to a remote location such as a beach or ice-fishing location are known in the art. U.S. Pat. No. 2,465,147—Butler et al discloses a structure which may be pivoted open around a vertical pole and used, for example, for ice-fishing. Similarly, U.S. Pat. No. 2,784,779—Knipfer et al teaches a wind break which can be collapsed for carrying. In U.S. Pat. No. 3,913,598—Glutting, Jr. et al, a collapsible screen is embodied for use as a hunter's blind. In each of the foregoing inventions, portable means are provided to support some form of panel in an upright position. Although each device can be folded to an extent, the devices remain relatively bulky.

In U.S. Pat. No. 2,445,622—Leuk, a sun-shield device formed of rigid frame elements is folded into a small enough package that the user can transport it by a handle. Similarly, in U.S. Pat. No. 3,487,874—Solo, a handle-carryable structure includes sheet material which can be erected in protective screen. These devices fail to disclose any particular means of carrying articles other than the screen-supporting structure itself.

A wide variety of collapsible screen members are known for various uses such as supporting displays and the like. Such screens occasionally include some form of pocket member for holding items to be displayed. An example of such a device is shown in U.S. Pat. No. 4,127,196—Boucher, wherein a wire-formed pamphlet support device is carried by an upright panel. This device is not foldable, or if foldable, requires the removal of structure including the so-called pocket.

Various other knock-down screens are also known in the art. Frequently, the screens include tubular elements adjacent the ends of a flexible sheet. The tubular elements are carried by horizontal frame members, in order to keep the sheet upright. Examples of such devices are shown in U.S. Pat. No. 1,250,429—Carroll and U.S. Pat. No. 1,595,929—Rhodes.

In U.S. Pat. No. 4,180,860—Ridgeway, Jr., a tent member is disclosed in which a pocket is provided in a central portion of a sheet. The pocket is intended to allow the user to place the entire device in the pocket for storage. Such devices are used by turning the pocket inside out around the sheet, tent, or the like. Therefore, although a form of pocket is included, the pocket is devoted to the transportation of the article itself.

According to the invention, a screen for protection from wind, sand, sun and the like can likewise function as a carrying bag for transportation of articles to and from a beach, ice-fishing location, product exhibition site or the like. A collapsible screen is employed, and pockets are formed in the collapsible screen to be oriented oppositely outwards from the center of the screen when erected. When the screen is taken down and folded along the seam between the pockets, the pockets become similarly oriented and can be used to carry articles of any description. In a preferred embodiment, the invention is used as a beach wind screen, and may be used to carry towels, books, suntan lotion and the like. The sand-engaging portion of the screen, namely a pair of stakes to be driven into the sand, form one or more handles for the entire device which can be used as a hand-carried bag, or can be rested over the user's shoulder in a manner reminiscent of a "hobo" bag. A number of variations are disclosed.

SUMMARY OF THE INVENTION

It is an object of the invention to maximize convenience in the use of a portable partition, panel or screen, by providing means on the panel to carry articles convenient for use together with the panel.

It is also an object of the invention to provide a cheap and convenient means for transporting articles to a beach or other remote location.

It is another object of the invention to facilitate transportation of articles together with transportation of a screen or sheet-like support member which can be used as a barrier or means for mounting items to be displayed.

It is still another object of the invention to provide a screen which is portable, lightweight and compact.

These and other objects are accomplished by a combined wind screen and beach bag which is formed from an elongated sheet carried by poles or rods at opposite ends thereof, the sheet having pockets opening towards said rods formed in part by a seam intermediate the stakes, such that the entire screen can be folded along the seam and articles can be carried in the pockets.

BRIEF DESCRIPTION OF THE DRAWINGS

There are shown in the drawings the embodiments which are at present preferred. It should be understood, however, that the invention is not limited to the precise arrangements and instrumentalities shown in the drawings, wherein:

FIGS. 7(*a*) through 7(*c*) are progressive steps in folding the embodiment of FIG. 2 into an alternative carrying bag.

DETAILED DESCRIPTION OF THE PREFERRED EMBODIMENTS

Figure 1:
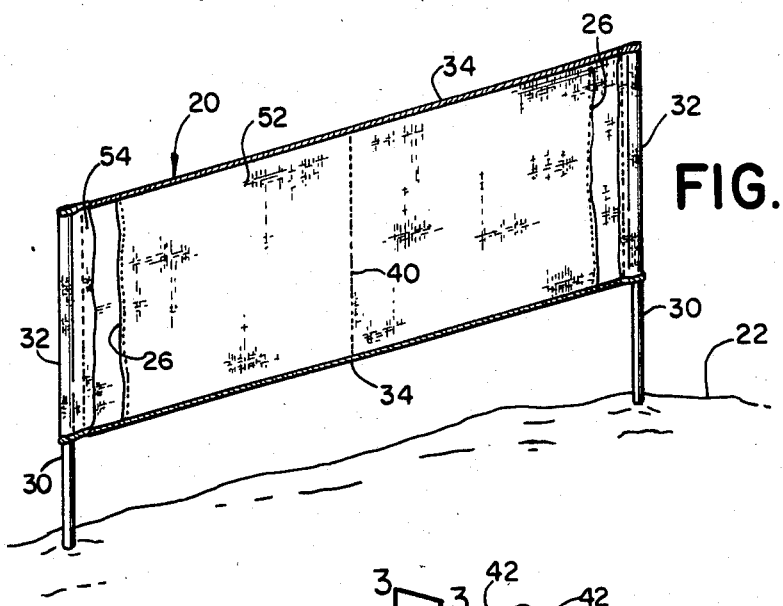
FIG. 1 is a perspective view of an erected screen according to the invention.

A preferred embodiment of the invention is shown in FIG. 1. Screen 20 is shown in FIG. 1 to be erected on supporting surface 22, which may be, for example, a beach. A pair of spaced stakes or posts 30 are preferably driven vertically into supporting surface 22. In the event supporting surface 22 is a beach, a simple rod will suffice to support the apparatus in the loose sand of surface 22. If surface 22 is a surface of ice or the like, then durable stakes will be required for driving, and if surface 22 cannot be pierced, for example, a concrete or indoor wood floor, then vertical support stakes 30 can be provided with a flat weighted base apparatus adapted to rest on surface 22.

Screen 20 is preferably formed in an elongated rectangle of flexible sheet material. Long edges 34 may, for example, be horizontally-oriented and shorter edges 32 can be vertical. The apparatus can also be taller than it is wide, or in some shape other than rectangular. In any event, when erected at a beach, ice-fishing location or the like, screen 20 will protect a user from the wind, or in appropriate circumstances, from the sun or merely from view.

According to the invention, the screen 20 also functions as a carrying device by means of pockets 26. Pockets 26 are oppositely directed enclosures opening toward the ends of screen 20, for example ends 32, such that when the screen is centrally folded, the oppositely-oriented pockets become similarly-oriented for carrying various articles. Preferably, pockets 26 are formed by folding a single sheet over to form two layers or by attaching two sheets 52, 54 in face-to-face relationship. The sheets are sewn or otherwise attached together along the longer edges 34 of screen 20 to form a flattened tube. The walls of the tube are joined to form pockets 26 along a central seam 40. Seam 40 can be located as required between ends 32, but it is presently preferred that seam 40 be more or less centrally located, equidistant between ends 32, and running parallel thereto, whereby the seam 40 is positioned at the fold that results when device 20 is folded to bring ends 32 together.

Figure 2:
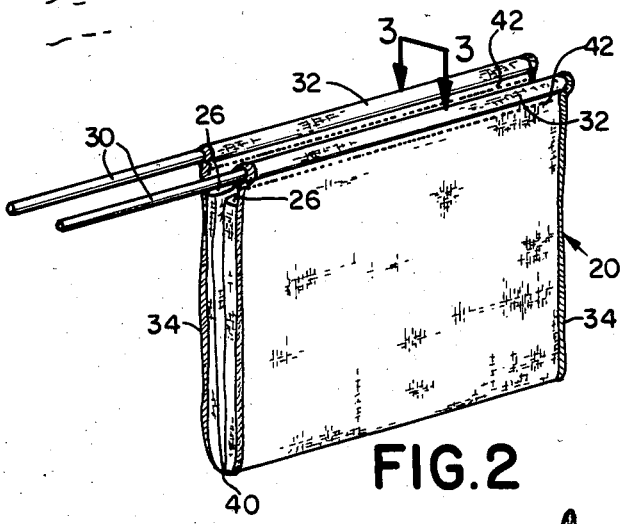
FIG. 2 is a perspective view of the screen of FIG. 1, folded to operate as a carrying bag.

As shown in FIG. 2, screen 20 is made into a conventional carrying bag by bringing ends 32 together. Ends 32 can, of course, be brought together such that pockets 26 are on the inside or outside. In the event sheets 52, 54 both extend to edge 32, there will be little difference between folding one way or the other. Preferably, sheet 52 is shorter than sheet 54 such that the mouths of pockets 26 are spaced slightly from edges 32. In this manner, it is possible to more completely confine any articles in the pockets, because ends 32 are brought together over the mouths of the pockets. Of course, the extent to which ends 32 can be brought together will also depend upon the bulkiness of articles placed in pockets 26.

Front and back sheets 52, 54 can also be attached such that pockets 26 occur on opposite sides of sheet 20. At any rate, sheets 52, 54 are joined at the edges 34 (i.e., the edges to be doubled over), the joining of edges 34 forming a flattened tube in cross section. The walls of the flattened tube are joined at central seam 40. If desired, the outer hems along edges 34 can be covered over with a protective edge binding to prevent fraying, and/or to provide a similar appearance to both edges 34.

Narrow tubular pockets are provided along each edge 32 for receiving rods or stakes 30. The narrow tubular receptacles for the stakes may be formed by simply folding over the edges 32 of sheet 54 and sewing a seam 42 parallel to the edge, thereby making a hollow hem for receiving rods 30. In order to prevent screen 20 from slipping over the end of rod 30, an upper end of the narrow tubular opening for stake 30 can be sewn shut, seam 42 running the length of each end 32 and also closing one corner.

Figure 3:
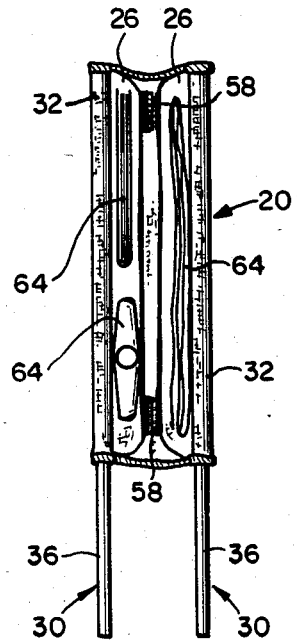
FIG. 3 is an elevation view taken along lines 3—3 in FIG. 2.

In using the apparatus as a carrying bag, the user need only fill the pockets as shown in FIG. 3, using extending ends 36 of stakes 30 as handles. Articles 64 can be any article required for the particular location of use. For example, in a beach wind screen, a book, towel, container of suntan lotion or other article can be carried.

As shown in FIG. 3, it may desirable to attach the faces of inner sheet 52 to one another in order to keep the screen 20 in folded condition. Suitable loop and pile fasteners 58 will suffice for this purpose, or other fasteners can likewise be used. It may be desirable, for example, to place a tube over the extending end 36 of stakes 30. The openings of pockets 26 can also be provided with a closure such as a zipper, button or the like.

Figure 4:
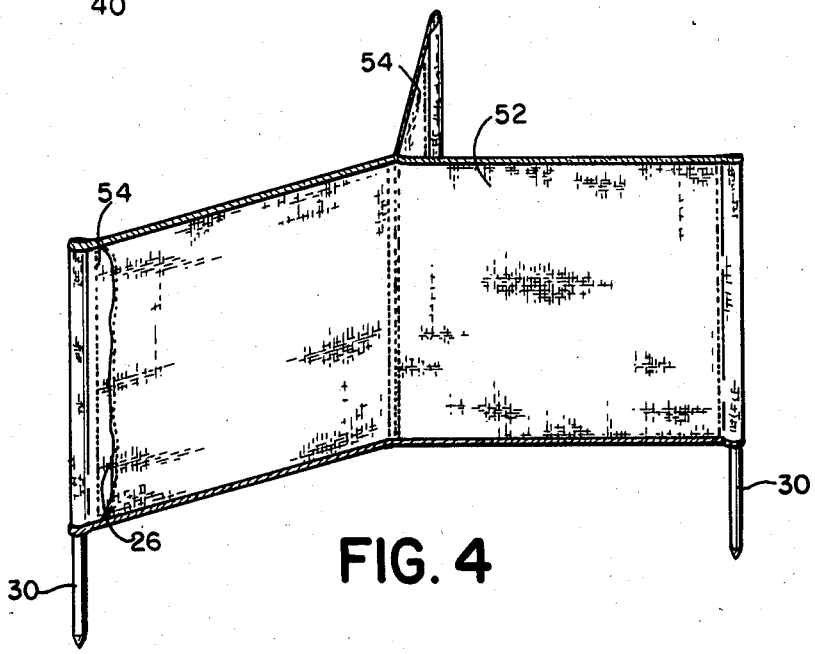
FIG. 4 is a perspective view of an alternative embodiment.

Some variation in the design and orientation of pockets 26 can be provided without departing from the invention. As shown in FIG. 4, an alternative embodiment of the invention is possible in which front and rear sheets 52, 54, respectively, are only joined into a pocket 26 at one end of screen 20. In this embodiment, at the opposite end from pocket 26 sheets 52, 54 are left unconnected, and two supporting stakes are provided. This embodiment would be useful as an exhibition device for trade shows and the like, in which it may be desirable to have an increased number of display surfaces.

Figure 5:
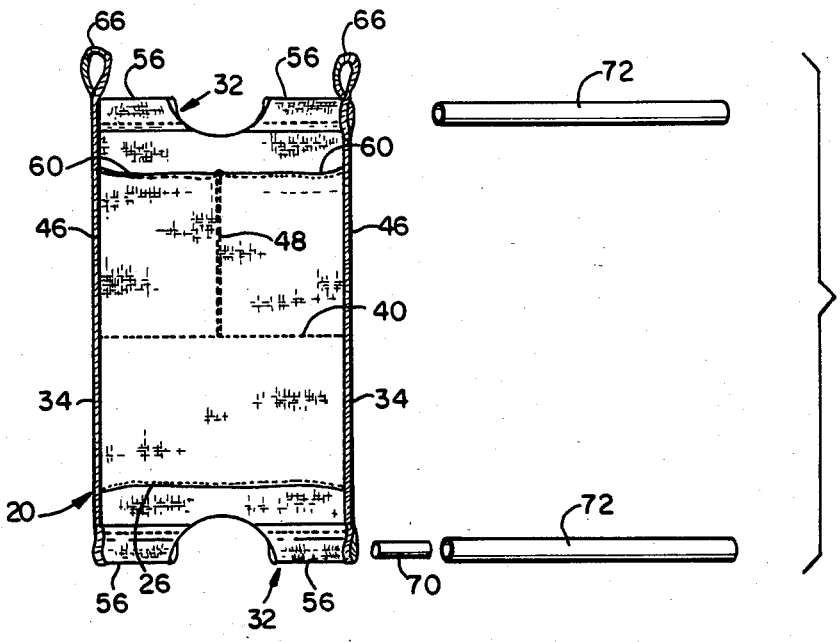
FIG. 5 is an exploded view of another alternative embodiment.

Another alternative embodiment of the invention is shown in FIG. 5. Display screen 20 is provided at ends 32 with tubular receptacles 56, for engaging rods 72, leaving a central portion in which the supporting rods 72 rather than the tubular receptacles therefor, are exposed for gripping by the user.

The embodiment of FIG. 5 also illustrates the longitudinal division of one of the oppositely-directed pockets into a pair of side-by-side pockets 60 by means of a seam 48 running parallel to edges 34. In this embodiment, seams 46 connect the facing sheets along edges 34, and together with central seam 40 and longitudinal division seam 48, define one large pocket 26 and two smaller pockets 60. If desired, sub-pockets such as those shown in FIG. 5 can be oriented in different directions, for example, providing upwardly-oriented pockets even when screen 20 is erected.

In order to more conveniently carry the device of the invention when used as an article-carrying bag, the embodiment of FIG. 5 is characterized by a means for attaching both ends 32 to a single length of supporting rod. In this embodiment, a dowel 70, dimensioned to fit snugly within the ends of tubular supporting rods 72, functions to join rods 72 in end-to-end relationship. One of the connected rods or stakes 72 is then placed in tubular receptacles 56 at one of the ends 32, and the opposite end 32 is attached to the same stake by means of elastic loops 66, provided at the corners of said opposite end 32. According to this embodiment, a relatively elongated stake may be then rested on a user's shoulder for carrying the entire article-carrying apparatus in the manner of a "hobo" bag.

The screen may be dimensioned as required for the expected conditions. A long low screen (e.g., 40 cm$\times$1 m) as in FIG. 1 may be most suitable at a windy beach. A relatively higher screen as in FIG. 5 (e.g., 1$\times$2 m) may be more useful in a display use.

Figure 6:
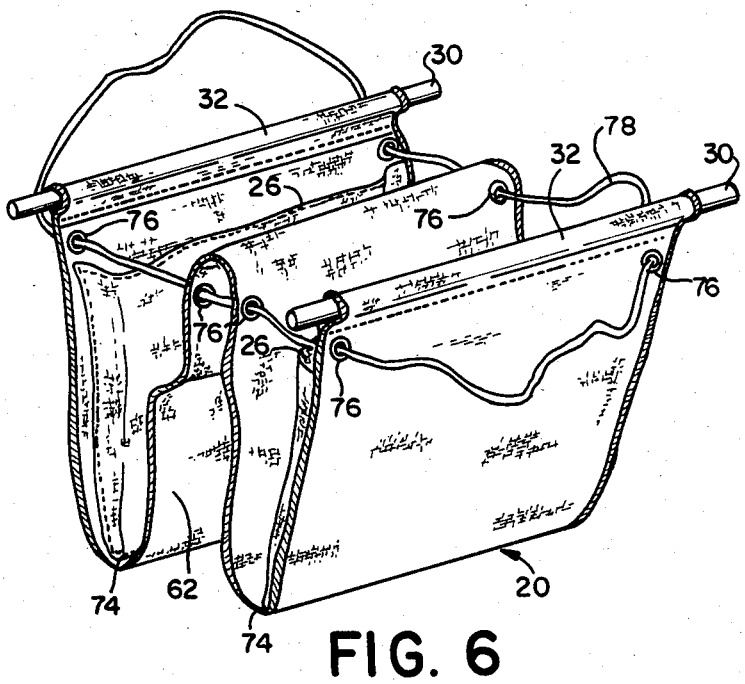
FIG. 6 is a perspective view of yet another alternative embodiment.

Another alternative means of supporting the wind screen is illustrated in FIG. 6. A drawstring 78, running through eyelet 76 may be passed over the user's shoulder, thereby drawing ends 32 of sheet 20 toward one another. In bringing ends 32 together, the user simultaneously directs pockets 26 upwards for carrying articles. In FIG. 6, pockets 26 are formed by spaced seams 74. In order to reduce the overall height of the apparatus, an additional fold 62 is also supported by drawstring 78. This reduces the height of the device when folded, but it will be appreciated that the depth of pockets 26 is correspondingly reduced.

Suitable materials for use in the apparatus will also depend to an extent and use of the screen. For use as a wind screen at the beach, light weight nylon is an appropriate material. If articles are to be attached to the face of the panel, for example, to function as a product exhibition or display, then burlap or heavy canvas may be more appropriate for longer wear.

FIGS. 7(*a*) through 7(*c*) illustrate steps of folding the screen of FIG. 2 to form another type of "hobo" bag. Folding the device in this manner also provides an additional number of receptacle areas for carrying articles and the like. As a first step, the user directs the handle ends of rods 30 outwards, and the opposite ends thereof toward one another. This allows one edge 34 to become slack while the other is made taut. The screen panel is then laid flat, with pockets 26 both up, both down, or on opposite sides. The screen is made flat in FIG. 7(*b*) with the pockets 26 outward, pockets 26 each have a diagonal fold 28. In progressing from FIG. 7(*b*) to 7(*c*), the user can rotate rods 30 either upwards or downwards around central seam 40, bringing the handle ends of rod 30 together. In other words, rods 30 are rotated in a plane perpendicular to the sheet. In this manner, pockets 26 are exposed to carry articles, although pockets 26 are somewhat restricted by fold 28. The screen is shown in FIG. 7(*c*) as having pockets 26 facing outwards.

Should the screen be folded such that pockets 26 face inward, the central portion of screen 20 adjacent seam 40 wraps around the outer part of the device, and forms a receptacle, in addition to pockets 26, between the body of the screen and the rear-side sheet 54 of pockets 26. A fold of this type causes the weight of any article placed in the additional receptacle to urge the folded device more tightly around the article. Folding the screen as shown in FIG. 2 to form the folded hobo bag of FIG. 7(*c*) provides additional smaller receptacles, and is somewhat easier for the user to carry over his or her shoulder. It will be appreciated that the direction of each fold 28 and the direction of fold at seam 40 can be varied to achieve several alternatives in which pockets 26 may be accessible, and in which a relatively large area may be enclosed by an outer-wrapped length of material.

The invention having been thus disclosed, a number of variations will now occur to persons skilled in the art. Reference should be made to the appended claims rather than the foregoing specification as indicating the true scope of the invention.

What is claimed is:

1. A combined windscreen and beach bag, comprising:

a flexible panel with side edges and opposite ends, foldable along a line intermediate the opposite ends;

stake means at the opposite ends for supporting the panel as a windscreen with the opposite ends perpendicular to a surface, the stake means being substantially parallel to the opposite ends and extending beyond a side edge of the panel to form handle means for carrying the panel as a beach bag;

at least one pocket formed in the panel substantially coextensive with approximately one-half of the panel, the pocket having an opening directed towards one of the ends;

the beach bag defined by two diagonal folds in which the stake means are substantially aligned with a side edge, and a further fold formed when the stake means are juxtaposed, the beach bag so defined having at least three substantially triangular pockets opening towards said stake and handle means, whereby said beach bag can be quickly and easily formed with articles fitting within and projecting out of the at least one pocket formed in the panel, and whereby articles fitting within and projecting out of all of the triangular pockets can be easily carried.

2. The apparatus of claim 1, wherein said panel is fabric having two layers, said pocket being formed by joining the layers along the opposite edges of the panel and along said foldable line.

3. The apparatus of claim 1, wherein said flexible panel is formed into narrow tubes disposed along each of said opposite ends, and said means for supporting the panel is a pair of rods adapted to fit in the tubes, the rods being engagable with the supporting surface to extend upright.

4. The apparatus of claim 1, wherein said panel is a pair of facing fabric sheets forming an elongated rectangle of flattened tubular cross-section, said facing sheets being joined by a seam spaced from the opposite ends to form at least a pair of pockets oriented in opposite directions and opening toward the opposite ends.

5. A combined windscreen and beach bag, comprising:

a pair of stakes for upright engagement with a supporting surface;

an elongated sheet having side edges and opposite ends, the opposite ends being attachable to the stakes, the stakes extending beyond a side edge to form handle means, the sheet being a windscreen when erected on the stakes;

at least one carrying pocket formed in the sheet and oriented to open towards one of the stakes;

the beach bag defined by two diagonal folds in which the stake means are substantially aligned with a side edge, and a further fold in which the stake means are juxtaposed, the beach bag so defined having at least three substantially triangular pockets opening toward said stake and handle means, whereby said beach bag can be quickly and easily formed with articles fitting within and projecting out of the at least one pocket formed in the panel, and whereby articles fitting within and projecting extending out of all of the pockets can be easily carried.

6. The screen of claim 5, further comprising means for holding the ends together when the sheet is folded.

* * * * *